US006969242B2

(12) United States Patent
Yannascoli et al.

(10) Patent No.: US 6,969,242 B2
(45) Date of Patent: Nov. 29, 2005

(54) COMPRESSOR

(75) Inventors: Donald Yannascoli, Manlius, NY (US); Stephen L. Shoulders, Baldwinsville, NY (US)

(73) Assignee: Carrier Corpoation, Syracuse, NY (US)

( * ) Notice: Subject to any disclaimer, the term of this patent is extended or adjusted under 35 U.S.C. 154(b) by 300 days.

(21) Appl. No.: 10/376,139

(22) Filed: Feb. 28, 2003

(65) Prior Publication Data

US 2004/0170512 A1 Sep. 2, 2004

(51) Int. Cl.[7] ..... F04B 17/00; F01C 1/16; F01C 19/00

(52) U.S. Cl. ..... 417/410.4; 417/410.3; 418/201.1; 418/141; 277/412

(58) Field of Search ..... 417/410.4, 313, 417/410.3, 572; 418/201.1, 140, 141; 277/412

(56) References Cited

U.S. PATENT DOCUMENTS

| | | | | |
|---|---|---|---|---|
| 3,063,378 | A * | 11/1962 | Hart | 418/79 |
| 3,156,191 | A * | 11/1964 | Lauck | 418/102 |
| 3,811,805 | A * | 5/1974 | Moody et al. | 418/88 |
| 4,375,156 | A * | 3/1983 | Shaw | 62/468 |
| 4,983,106 | A * | 1/1991 | Wright et al. | 418/2 |
| 5,051,077 | A * | 9/1991 | Yanagisawa et al. | 418/201.1 |
| 6,095,780 | A * | 8/2000 | Ernens | 418/104 |
| 6,485,279 | B2 * | 11/2002 | Zhong et al. | 418/141 |

* cited by examiner

*Primary Examiner*—Timothy P. Solak
(74) *Attorney, Agent, or Firm*—Bachman & LaPonite, P.C.

(57) ABSTRACT

To counter downstream oil infiltration through a shaft seal, a small portion of the compressed fluid is diverted from downstream to upstream through a passageway in a rotor. The diverted fluid is introduced to a space at a downstream side of the seal. An exemplary implementation is in a compressor having a central male rotor intermeshed with a pair of female rotors. The seal is located at an upstream (inlet) end of the lobed working portion of the male rotor.

20 Claims, 3 Drawing Sheets

COMPRESSOR

BACKGROUND OF THE INVENTION (1) Field of the Invention

This invention relates to compressors, and more particularly to screw-type compressors.

(2) Description of the Related Art

Screw-type compressors are commonly used in refrigeration applications. In such a compressor, intermeshed male and female lobed rotors or screws are driven about their axes to pump the refrigerant from a low pressure inlet end to a high pressure outlet end. In one implementation, the male rotor is coaxial with an electric driving motor and is supported by bearings on inlet and outlet sides of its lobed working portion. An exemplary inlet side bearing is a roller bearing. Such bearings require oil for lubrication. If not prevented from doing so, such oil may exit the bearing cavity and become entrained in refrigerant as it passes downstream through the compressor. For some applications this is not advantageous. There may be a tendency for oil to accumulate in the evaporator of the refrigeration system. A reclamation system may be provided to return this oil to the compressor.

Various shaft seal arrangements have been used to hinder the leakage of oil from bearing cavities. A shaft seal arrangement that is well known in the general art of compressor design is the buffered labyrinth seal. In such a seal, a flow of gas at moderate or high pressure is introduced into a buffer volume interposed between two sets of annular teeth that are in close-running proximity to the rotor shaft. The gas flow raises the pressure of the buffer volume above the pressure in the bearing cavity, thereby causing gas flow into the bearing cavity to prevent the flow of oil out of the bearing cavity. The annular teeth act as flow restrictions which allow for development of higher pressure in the buffer volume without requiring an excessive gas flow rate.

BRIEF SUMMARY OF THE INVENTION

A compressor has a housing containing male and female rotors having intermeshed screw-type bodies extending between first and second ends and held by the housing for rotation about associated axes. A first bearing on an inlet side of a first (e.g., the male) rotor body radially retains the first rotor relative to the housing while allowing the first rotor to rotate at least in a first direction about its axis. Rotation of the first direction acts to compress a fluid and drive the fluid in a downstream flow direction defining inlet and outlet ends of the male and female rotor bodies and an associated inlet-to-outlet direction. At least a first seal seals the first rotor relative to the housing assembly at a location between the first bearing and the first rotor body. The first rotor has at least one passageway having first and second ports and positioned to direct a portion of the fluid to a space between the first body portion and the first seal.

In various implementations, the passageway may extend parallel to the male rotor axis and the first and second ports may respectively be formed in inlet and outlet end portions of the male rotor body. A motor may be coupled to the male rotor to drive the male rotor at least in the first direction and may be coaxial with the male rotor. The motor may be an electric motor having a rotor and a stator and the male rotor may have a shaft extending into and secured to the rotor. There may be a second bearing on an outlet side of the male rotor body radially retaining the male rotor relative to the housing assembly while allowing the male rotor to rotate about the first axis. There may be third and fourth bearings on respective inlet and outlet sides of the female rotor body radially retaining the female rotor relative to the housing while allowing the female rotor to rotate about its axis. The first seal may be a labyrinth seal having teeth extending radially inward. The space may be bounded by a frustoconical interior portion of a surface of the first seal. The first seal may lack additional teeth engaging the upstream surface of the rotor. The first bearing may be a rolling element bearing. The male rotor may have a working diameter equal to or larger than the female.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
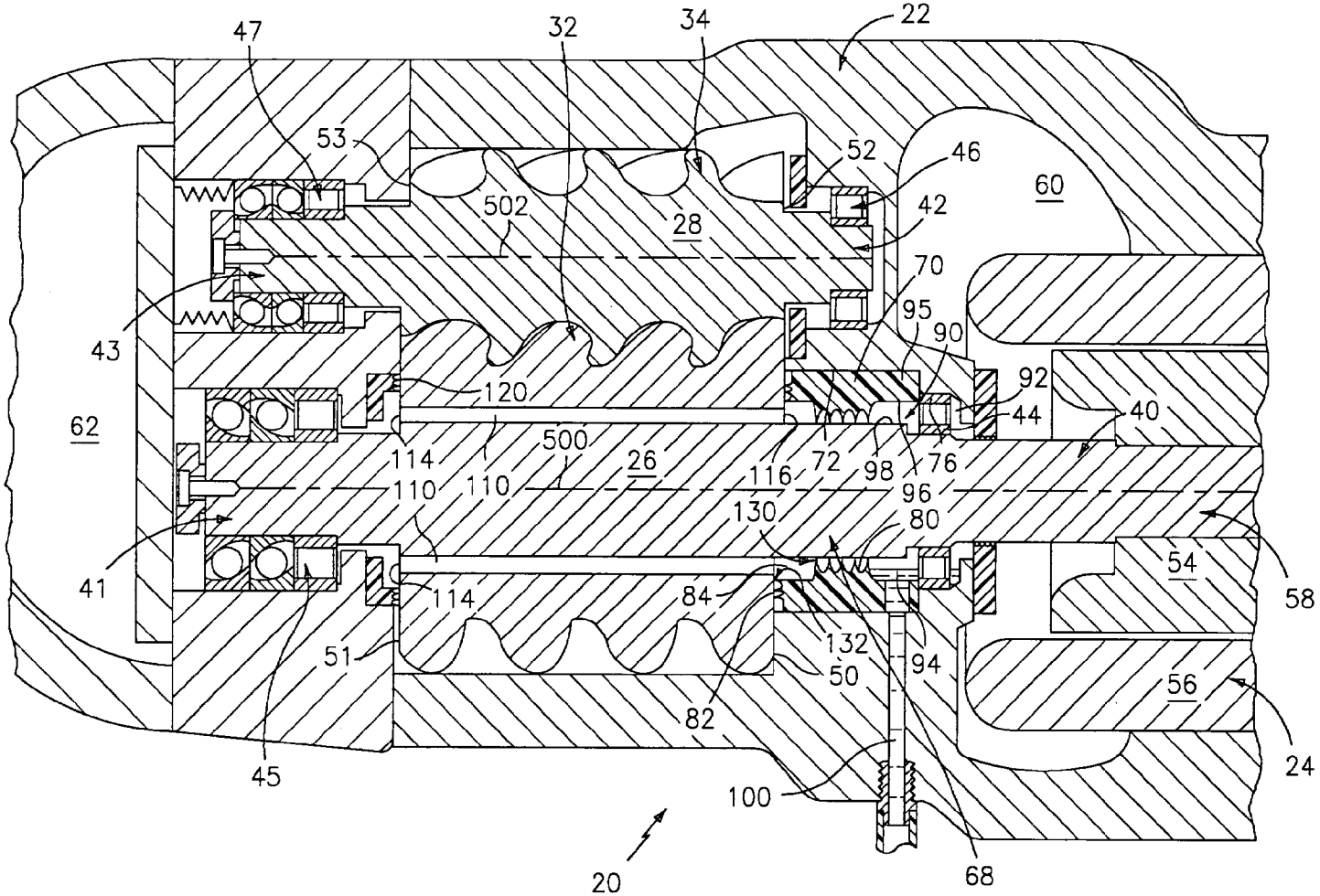
FIG. 1 is a partially schematic longitudinal sectional view of a first compressor.

FIG. 1 shows a compressor 20 having a housing assembly 22 containing a motor 24 driving two rotors 26 and 28 having respective central longitudinal axes 500 and 502. In the exemplary embodiment, the rotor 26 has a male lobed body or working portion 32 enmeshed with a female lobed body or working portion 34 of the female rotor 28. Each rotor includes shaft portions (e.g., shafts 40, 41 and 42, 43, unitarily formed with the associated working portion 32 and 34) extending from first and second ends of the working portion. Each of these shafts is mounted to the housing by one or more bearing assemblies 44, 45 and 46, 47 that allow for rotation of the rotors about the associated rotor axes. Each rotor working portion also includes inlet (upstream) and outlet (downstream) end faces (surfaces) 50, 51 and 52, 53, that are surfaces extending perpendicular to the associated rotor axes.

In the exemplary embodiment, the motor is an electric motor having a rotor 54 and a stator 56. A distal portion 58 of the first shaft 40 of the male rotor 26 extends within the rotor 54 and is secured thereto so as to permit the motor 24 to drive the male rotor 26 about the axis 500. When so driven in an operative first direction about the axis 500, the male rotor drives the female rotor in an opposite direction about its axis 502. The resulting enmeshed rotation of the rotor working portions tends to drive fluid from a first (inlet) end plenum 60 to a second (outlet) end plenum 62 end while compressing such fluid. This flow defines downstream and upstream directions.

A proximal portion 68 of the male rotor first (inlet) shaft 40 is surrounded by a seal 70. The seal 70 is mounted within a generally cylindrical seal compartment or cavity 72 in the housing assembly immediately to the outlet side of the roller bearing assembly 44, itself mounted in a generally cylindrically bearing compartment 76 the housing for supporting the male rotor for rotation about the axis 500.

The seal 70 includes a set of radially inwardly directed annular first teeth 80 in close-running proximity to the shaft 40 and a longitudinally directed set of annular second teeth 82 in close-running proximity to the male rotor inlet end face 50. An annular buffer cavity 84 is interposed between tooth sets 80 and 82 on the outlet side of the teeth 80 and radially inboard of the teeth 82. Cavities 90 and 92 containing an oil accumulation (puddles) 94 are located on either side of the bearing 44. On the inlet side of the bearing assembly, the cavity 92 is radially encircled by the housing assembly. On the outlet side of the bearing assembly 44, the cavity 90 is encircled by an inlet end portion 95 of the seal 70. This portion has a surface 96 spaced substantially radially apart from an adjacent surface 98 of the shaft 40. The oil for lubricating the bearing 44 is introduced into the cavity 92 through an oil passage (not shown). Oil exits the cavity 92 by flowing through the bearing 44, thereby lubricating it, and entering the cavity 90. The cavity 90 is bounded by portions of the housing assembly and upstream portion 95 and annular teeth 80 of the seal 70. Oil preferably exits the cavity 90 only via an oil drain passage 100 but, if not otherwise prevented, may also exit by passing through the annular clearance between the teeth 80 and the shaft 40.

The male rotor 26 is provided with several longitudinal passageways 110 extending between the inlet and outlet end faces 50 and 51 of its working portion. Specifically, the passageways have inlets 114 in a radially inward portion of the face 51 and outlets 116 in the face 50. An axial seal 120 is provided to seal the housing relative to a radially outward portion of the face 51. The seal 120 is provided to resist high pressure fluid leakage between the face 51 and the adjacent housing surface in close running proximity. Such sealing is, however, imperfect. The passageways 110 serve to at least partially divert the leakage. The diverted leakage passes at moderate pressure from the outlet and toward the inlet and through the passageways 110 and is vented to the buffer cavity 84 through the outlets 116. The resulting pressure in the buffer cavity helps prevent upstream infiltration of oil from the cavity 90 into the downstream flow of refrigerant. The passageways 110 are preferably constructed in a dynamically balanced arrangement. In the exemplary embodiment, all passageways are at the same uniform radius relative to rotor axis 500 and equally spaced circumferentially. Thus, two passageways circumferentially 180° apart, three passageways 120° apart, or four passageways 90° apart would be suitable choices. The sets of seal teeth 80 and 82, the buffer cavity 84 and gas passageways 110 act in cooperation to provide a buffered labyrinth seal. Specifically, close-running clearances 130 and 132 between the teeth 80 and shaft 40 and between the teeth 82 and end face 50 restrict flow out of the buffer cavity 84. The flow of refrigerant gas at moderate pressure into the buffer cavity 84 through the passageways 110 raises the pressure in the buffer cavity 84 above the pressure in the cavity 90. As a result, some gas flows from the buffer cavity 84 through the clearance 130 and into the cavity 90 rather than oil flowing from the cavity 90 through the clearance 130 and into the buffer cavity 84.

Figure 2:
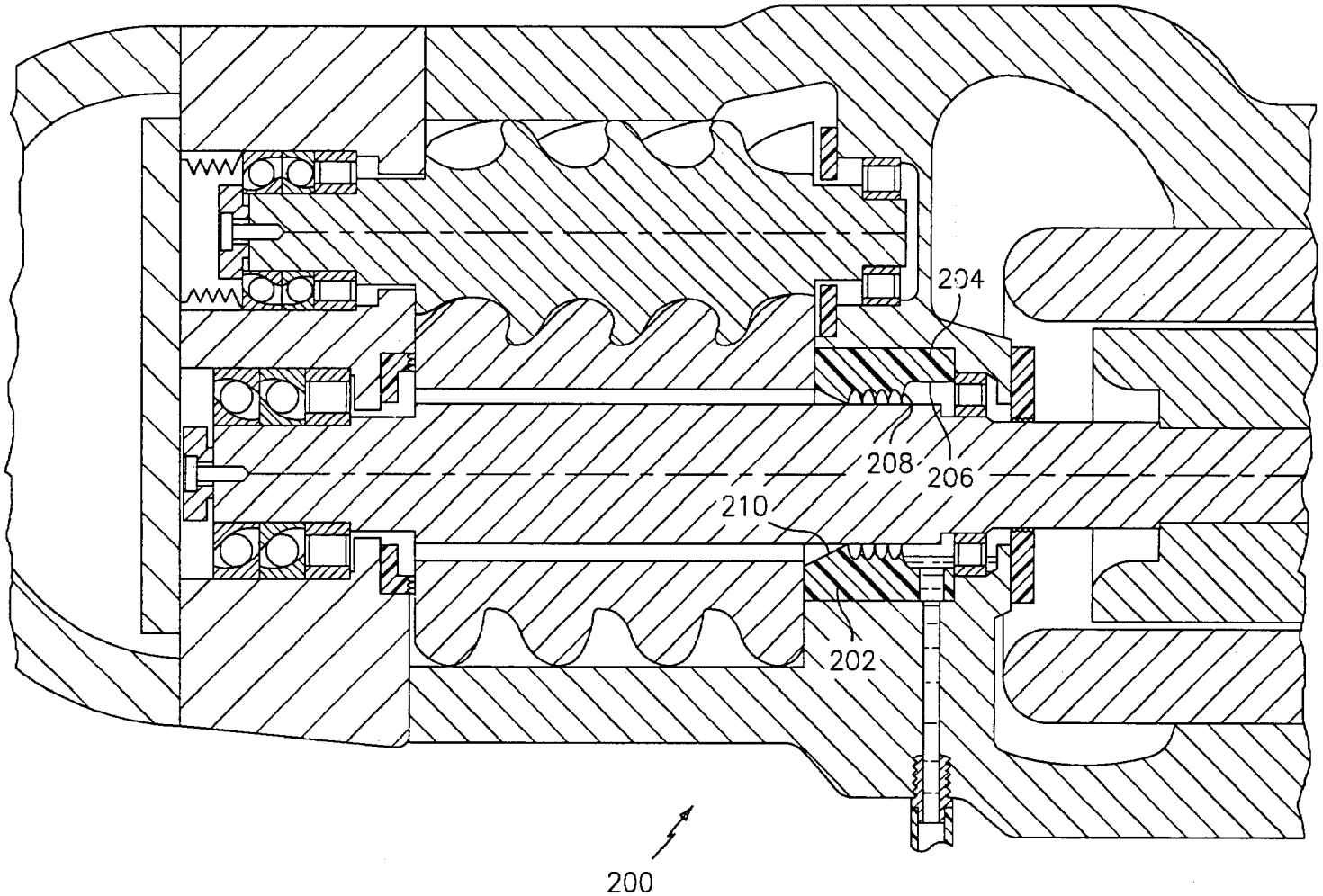
FIG. 2 is a partially schematic longitudinal sectional view of a second compressor.

FIG. 2 shows an alternate compressor 200 having an alternate seal 202 in place of the seal 70 of FIG. 1. For purposes of illustration, other elements of the compressor may be identical to those of the compressor 20 of FIG. 1 and are not separately numbered and/or discussed. In the exemplary embodiment, the seal inlet end portion 204 and its inboard surface 206 may be similar to the portion 95 and surface 96 of the seal 70. On the outlet side of the surface 206, the seal has a sealing portion in the form of a set of teeth 208 extending radially inward. On the outlet (downstream) side of the teeth 208, the seal interior has a downstream divergent (e.g., frustoconical) surface 210. In the exemplary embodiment, the surface 210 extends toward the outlet end (downstream as defined by the main refrigerant flow) from an apex of a downstreammost one of the teeth 208. This is distinguished from the surface of the outlet side portion of the seal 70 extending longitudinally from a root of the downstreammost tooth. Furthermore, the surface 210 extends to an outlet side flat annular rim 220 (FIG. 3) of the seal 202. Thus, there may be an absence of longitudinally extending teeth sealing with the rotor working portion inlet side (upstream) face. The teeth 208 have a clearance 230 with the adjacent surface of the shaft and the rim 220 has a clearance 232 with the upstream face of the rotor working portion. In the exemplary embodiment, the clearance 232 is substantially larger than the clearance 132 of FIG. 1. This may provide substantial flexibility in the clearance 232, thereby permitting use of a less precise manufacturing and assembling techniques. The surface 210, the adjacent portion of the shaft surface, and the adjacent portion of the upstream face of the male rotor working portion define a cavity 212. Tapering the surface 110 directs flow 302 exiting the passageway toward the teeth 208. As the buffering flow moves through the cavity 212 toward the teeth 208 the available cross-sectional flow area converges, causing the flow to stagnate in the vicinity of the teeth and providing a local pressure increase as kinetic energy is converted to potential energy.

Figure 3:
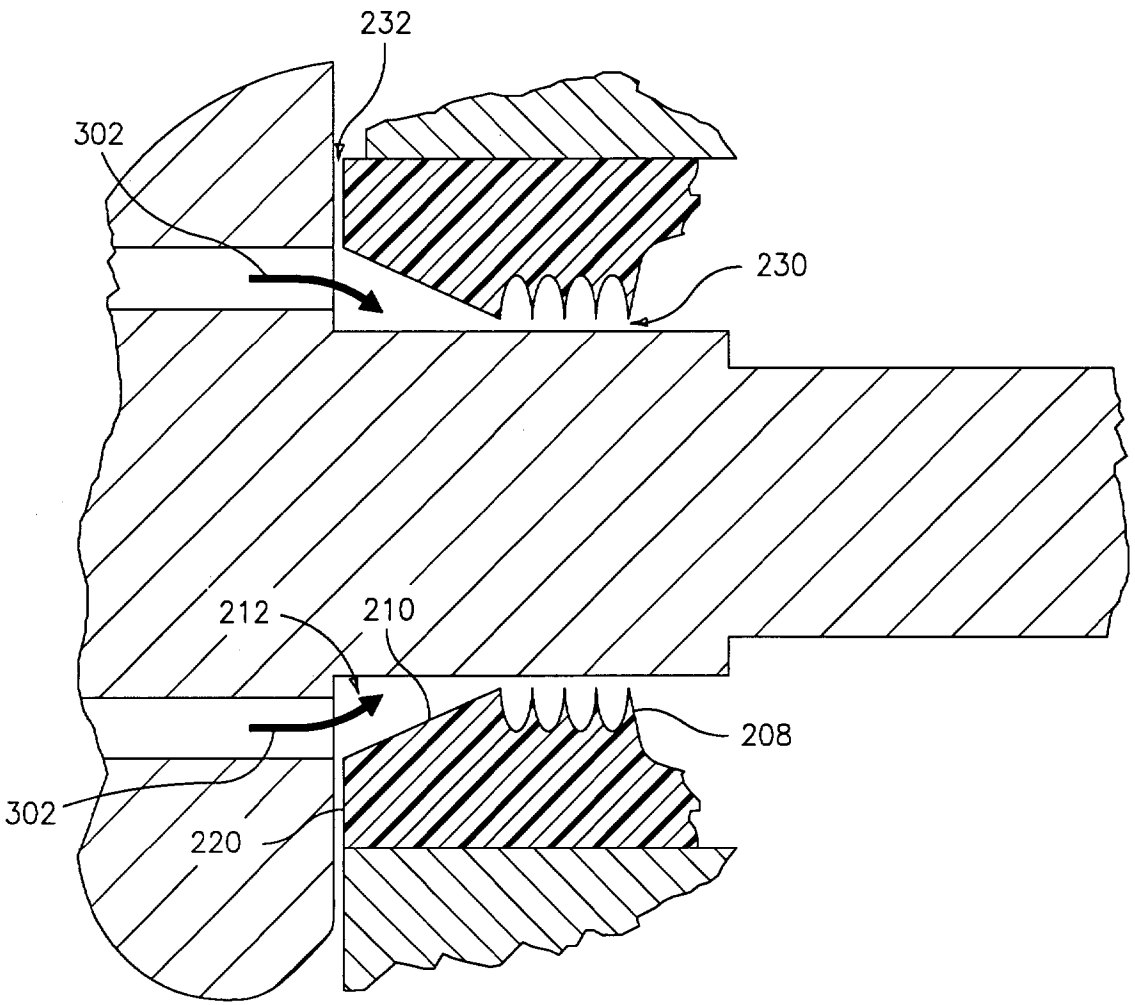
FIG. 3 is an enlarged view of a portion of the compressor of FIG. 2.

While such pressure rise is generally small, perhaps only a fraction of one pound per square inch at some operating conditions, this rise may nevertheless be enough to counter flow out of the bearing cavity through the clearance 230 and into the buffer cavity 212. The flow of gas from each passageway enters the buffer cavity 212 as a jet. As the passageways are rotating with the male rotor, the situation presented in FIG. 3 is essentially a "snapshot" at one instant of time during operation of the compressor 200. An exemplary rotational speed of the male rotor is in a range of ten to sixty revolutions per second (RPS) with at least two passageways present for dynamic balance of the male rotor, the situation presented in FIG. 3 repeats for each circumferential location at such a rapid rate that the seal is effective to prevent downstream oil flow out of the bearing cavity and between the seal and rotor.

One or more embodiments of the present invention have been described. Nevertheless, it will be understood that various modifications may be made without departing from the spirit and scope of the invention. For example, when implemented as a redesign of an existing compressor, details of the existing compressor may influence details of the implementation. Accordingly, other embodiments are within the scope of the following claims.

What is claimed is:

1. A compressor comprising:

a housing assembly; and a male rotor having a male screw-type body portion, the male rotor extending from a first end to a second end and held by the housing assembly for rotation about a first rotor axis;

a female rotor having a female screw-type body portion enmeshed with the male body portion, the female rotor extending from a first end to a second end and held by the housing assembly for rotation about a second rotor axis;

at least a first bearing on an inlet side of the male body portion and radially retaining the male rotor relative to the housing assembly while allowing the male rotor to rotate at least in a first direction about the first axis, rotation in said first direction acting to compress a fluid and drive the fluid in a downstream flow direction defining inlet and outlet ends of the male and female body portions and an associated inlet-to-outlet direction; and at least a first seal, sealing a first rotor of the male rotor and female rotor relative to the housing assembly at a location between the first bearing and the body portion of the first rotor, wherein:

the first rotor has at least one passageway having first and second ports and positioned to direct a portion of the fluid to a space between the body portion of the first rotor and the first seal.

2. The compressor of claim 1 wherein the first rotor is the male rotor.

3. The compressor of claim 2 wherein:

said at least one passageway extends parallel to the first axis and the first and second ports are respectively formed in inlet and outlet end portions of the male rotor body portion.

4. The compressor of claim 2 further comprising a motor coupled to the male rotor to drive the male rotor in at least said first direction about the first rotor axis and wherein the motor and male rotor are coaxial.

5. The compressor of claim 4 wherein the motor is an electric motor having a rotor and a stator and the male rotor has a shaft portion extending into and secured to the rotor.

6. The compressor of claim 2 further comprising:

a second bearing on an outlet side of the male rotor body portion radially retaining the male rotor relative to the housing assembly while allowing the male rotor to rotate about the first axis; and third and fourth bearings on respective inlet and outlet sides of the female rotor body portion radially retaining the female rotor relative to the housing assembly while allowing the female rotor to rotate about the second axis.

7. The compressor of claim 1 wherein the first seal is a labyrinth seal.

8. The compressor of claim 1 wherein the space is partially bounded by a frustoconical interior portion of a surface of the first seal.

9. The compressor of claim 1 wherein the seal lacks longitudinally-extending teeth engaging a radially-extending inlet end portion of the body portion of the first rotor.

10. The compressor of claim 1 wherein the first bearing is a rolling element bearing.

11. The compressor of claim 1 wherein the body portion of the first rotor has an inlet end face;

there is a clearance between the inlet end face and an adjacent portion of the seal; and the passageway first port is in the inlet end face, radially inboard of the clearance.

12. The compressor of claim 11 wherein the space is partially bounded by a frustoconical interior portion of a surface of the first seal.

13. The compressor of claim 1 wherein the body portion of the first rotor has an inlet end face;

there is a clearance between the inlet end face and an adjacent portion of the seal; and the adjacent portion lacks teeth.

14. The compressor of claim 13 wherein the space is partially bounded by a frustoconical interior portion of a surface of the first seal.

15. The compressor of claim 1 wherein the body portion of the first rotor has an inlet end face; and the seal does not have teeth for sealing with the inlet end face.

16. The compressor of claim 15 wherein the space is partially bounded by a frustoconical interior portion of a surface of the first seal.

17. A compressor comprising:

a housing assembly; and a male rotor having a screw-type male lobed portion, the male rotor extending from a first end to a second end and held by the housing assembly for rotation about a first rotor axis;

a female rotor having a screw-type female lobed portion enmeshed with the male lobed portion, the female rotor extending from a first end to a second end and held by the housing assembly for rotation about a second rotor axis;

a motor coupled to the male rotor to drive the male rotor in at least a first direction about the first rotor axis, rotation in said first direction acting to compress a fluid and drive the fluid in a downstream flow direction defining inlet and outlet ends of the male and female body portions and an associated inlet-to-outlet direction;

at least a first bearing on an inlet side of the male body portion and radially retaining the male rotor relative to the housing assembly while allowing the male rotor to rotate about first axis;

oil lubricating the bearing;

at least a first seal, having a first radially inward directed portion sealing the male rotor relative to the housing assembly at a location between the first bearing and the male body portion; and means for diverting a flow of said fluid through at least one of the male and female rotors to resist infiltration of said oil between said first seal and said male rotor.

18. The compressor of claim 17 wherein the means comprises an off-center longitudinal passageway through said at least one of the male and female rotors.

19. The compressor of claim 17 wherein the means comprises a plurality of passageways through the male rotor.

20. The compressor of claim 17 wherein the male rotor has a working diameter equal to or greater than a working diameter of the female rotor.

* * * * *